US006988909B2

(12) United States Patent
Morizaki

(10) Patent No.: US 6,988,909 B2
(45) Date of Patent: Jan. 24, 2006

(54) ACTUATOR

(75) Inventor: Satoshi Morizaki, Toyokawa (JP)

(73) Assignee: ASMO Co., Ltd., Shizuoka-Ken (JP)

( * ) Notice: Subject to any disclaimer, the term of this patent is extended or adjusted under 35 U.S.C. 154(b) by 0 days.

(21) Appl. No.: 10/816,486

(22) Filed: Mar. 31, 2004

(65) Prior Publication Data

US 2004/0198090 A1 Oct. 7, 2004

(30) Foreign Application Priority Data

Apr. 2, 2003 (JP) ..... 2003-099667

(51) Int. Cl.
*H01R 11/20* (2006.01)

(52) U.S. Cl. ..... 439/404; 439/392

(58) Field of Classification Search ..... 439/392, 439/395, 404 I, 405, 417, 668
See application file for complete search history.

(56) References Cited

U.S. PATENT DOCUMENTS 3,634,605 A * 1/1972 Dola ..... 174/88 R
4,284,316 A * 8/1981 Debaigt ..... 439/392
4,326,767 A * 4/1982 Silbernagel et al. ..... 439/392
4,444,447 A * 4/1984 Markwardt ..... 439/392
6,848,933 B1 * 2/2005 Delaney et al. ..... 439/392

FOREIGN PATENT DOCUMENTS

JP 02-201881 8/1990

* cited by examiner

*Primary Examiner*—Thanh-Tam Le
(74) *Attorney, Agent, or Firm*—Sheridan Ross P.C.

(57) ABSTRACT

An actuator that reduces the number of components, simplifies connection, and lowers costs. The actuator includes a connector body and a cover. The connector body has an input terminal and an output terminal. The cover holds a harness with the connector body. The connector body or the cover includes a cutter that is arranged between the input terminal and the output terminal. The cutter cuts a signal line of the harness into two cut pieces when attaching the connector body and the cover to each other. The input and output terminals each include two contact portions that penetrate through a coating of the signal line of the harness to contact one of the two cut pieces of the signal line when attaching the connector body and the cover to each other.

10 Claims, 6 Drawing Sheets

ACTUATOR

BACKGROUND OF THE INVENTION

The present invention relates to an actuator, and more particularly, to a plurality of actuators controlled independently of one another, an actuator system including a plurality of actuators, and a connector for connecting a plurality of actuators.

A typical actuator system, such as one used in a vehicle air conditioner, includes a plurality of actuators, each having a driving portion. The actuator system drives the driving portions of the actuators independently of one another. In such an actuator system, an address is set for each actuator. Further, the actuators are connected to one another and to a master controller through a local area network (LAN). The LAN decreases the number of wires in the actuator system.

Each actuator includes a connector connected to a signal line and power supply lines. Japanese Patent No. 2679209 describes an example of such a connector, which includes a plurality of terminals (contacts) and a cover. In this connector, a ribbon-shaped harness (flat cable) is sandwiched between the cover and a housing to connect the terminals to the signal line and power supply lines (wires) of the ribbon-shaped harness. More specifically, each terminal is bifurcated so as to define a slit between the bifurcated portions. The bifurcated portions penetrate through an insulation film, which covers the signal line and the power supply lines, when sandwiching the ribbon-shaped harness. This connects the signal and power supply lines to the terminal. Accordingly, the actuator, which includes such a connector, is easily connected to the ribbon-shaped harness.

When a plurality of actuators are connected to one another with such connectors and a single ribbon-shaped harness, each actuator is connected in parallel by the signal line. Due to the parallel connection, an address must be set beforehand for each actuator. Accordingly, there is a need for a circuit to set the ID numbers (e.g., a pattern corresponding to the addresses of the actuators must be configured on a substrate incorporated each of the actuators). This increases the cost of each actuator, which, in turn, increases the cost of an actuator system including a plurality of actuators.

When the above connector and single ribbon-shaped harness are not used and a plurality of actuators are daisy chain connected with one another, a different ID number does not have to be set for each actuator (the actuators may be identical to each other). If, however, the actuators are daisy chain connected, a plurality of signal lines become necessary to connect the actuators to one another. In an actuator system including a plurality of actuators, this increases the number of components and causes the connection of the actuators to become complicated. Thus, the configuration of an actuator system including a plurality of actuators is expensive.

SUMMARY OF THE INVENTION

It is an object of the present invention to provide an actuator, an actuator system, and a connector in which the number of components is decreased, the connecting operation is simplified, and the cost is lowered.

To achieve the above object, the present invention provides an actuator for connection to a harness including a signal line covered by a coating. The actuator has a connector body including an input terminal and an output terminal. A cover is attached to the connector body to hold the harness with the connector body. At least one of the connector body and the cover includes a cutting portion arranged between the input terminal and the output terminal to cut the signal line of the harness into two cut pieces when attaching the connector body and the cover to each other. The input terminal and the output terminal each include two contact portions that penetrate through the coating of the signal line of the harness to contact one of the two cut pieces of the signal line when attaching the connector body and the cover to each other.

Another aspect of the present invention is an actuator for connection to a harness including a signal line covered by a coating. The actuator includes a connector used to connect the actuator to the harness. The connector has a connector body including a first groove, which is shaped in correspondence with the harness, and an input terminal and an output terminal, which are arranged in the first groove. A cover holds the harness with the connector body. The cover includes a second groove corresponding to the first groove. A cutting portion is arranged between the input terminal and the output terminal in at least one of the first groove of the connector body and the second groove of the cover. The cutting portion cuts the signal line of the harness into two cut pieces when attaching the connector body and the cover to each other. The input terminal and the output terminal each include two contact portions that penetrate through the coating of the signal line of the harness to contact one of the two cut pieces of the signal line when attaching the connector body and the cover to each other.

A further aspect of the present invention is an actuator system including a harness having a signal line covered by a coating. A plurality of actuators are connected to the harness. Each of the actuators has a connector body including an input terminal and an output terminal. A cover holds the harness with the connector body. At least one of the connector body and the cover includes a cutting portion to cut the signal line of the harness into two cut pieces when attaching the connector body and the cover to each other. The input terminal and the output terminal each include two contact portions that penetrate through the coating of the signal line of the harness to contact one of the two cut pieces of the signal line when attaching the connector body and the cover to each other.

A further aspect of the present invention is a connector for connecting a plurality of devices by way of a harness including a signal line covered by a coating. The connector has a connector body including an input terminal and an output terminal. A cover holds the harness with the connector body. At least one of the connector body and the cover includes a cutting portion arranged between the input terminal and the output terminal to cut the signal line of the harness into two cut pieces when attaching the connector body and the cover to each other. The input terminal and the output terminal each include two contact portions that penetrate through the coating of the signal line of the harness to contact one of the two cut pieces of the signal line when attaching the connector body and the cover to each other.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Actuators A1 to An, an actuator system 100, and a connector 12 according to a preferred embodiment of the present invention will now be discussed with reference to FIGS. 1 to 9. Referring to FIG. 2, the actuator system 100 includes a master controller 1 and a plurality of actuators A1 to An (n is the quantity of the actuators and a positive integer that is two or greater). The actuator system 100 of the preferred embodiment is used in a vehicle air conditioner. The actuators A1 to An are each arranged on an air door in an air conditioner passage (not shown) to drive the air door.

Figure 1:
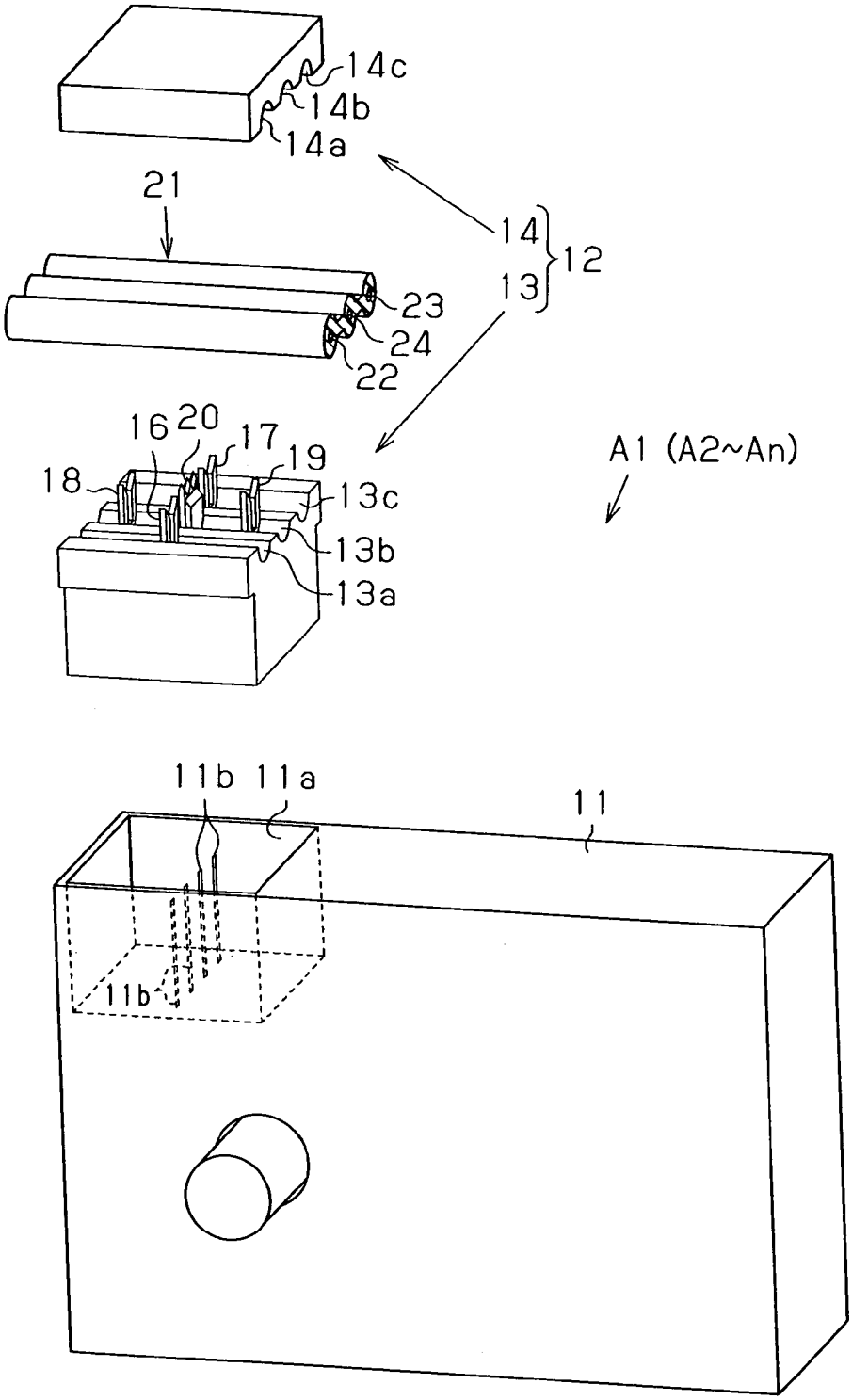
FIG. 1 is an exploded perspective view showing an actuator according to a preferred embodiment of the present invention.
Figure 2:
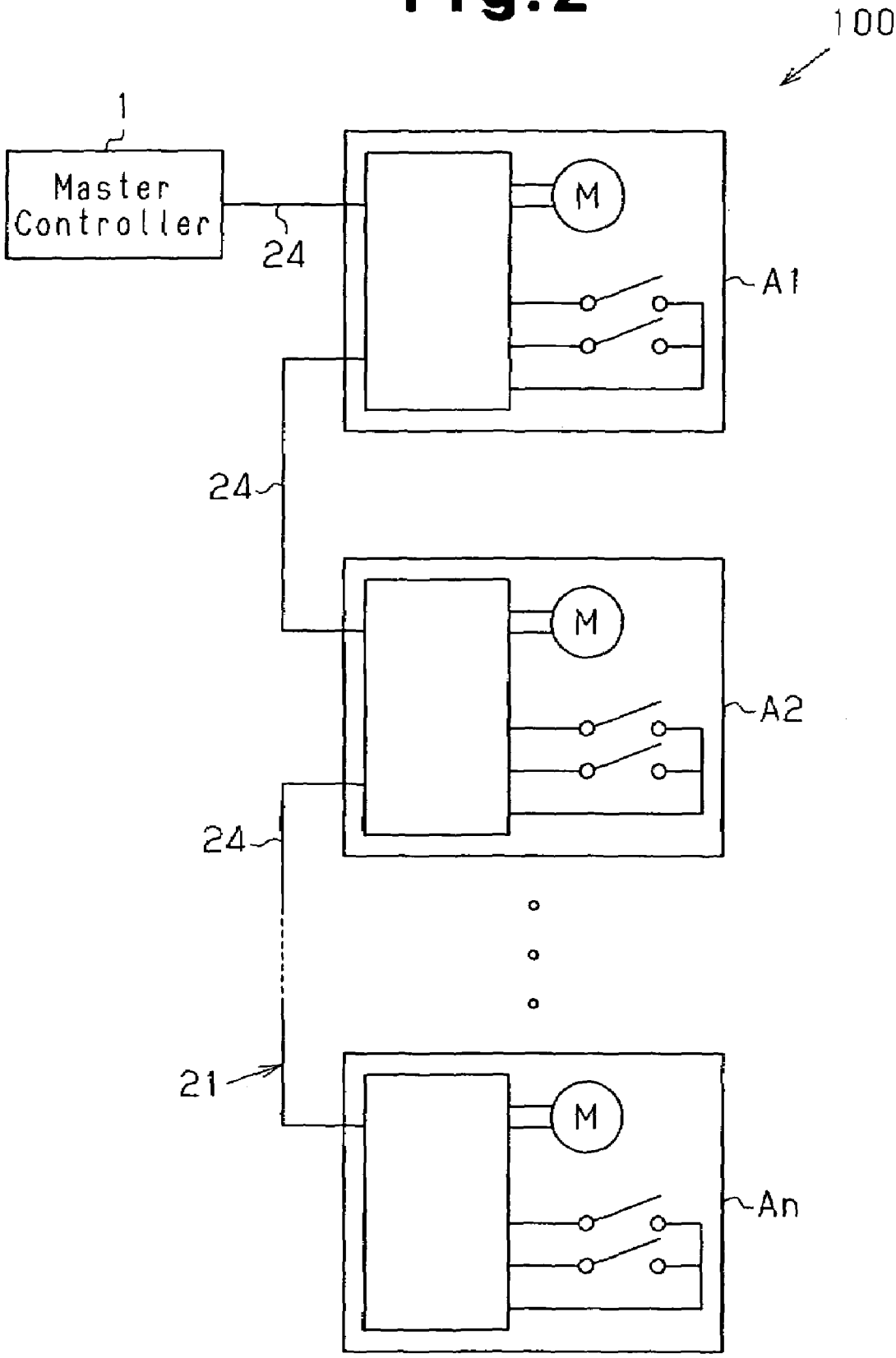
FIG. 2 is a schematic diagram of an actuator system according to the preferred embodiment of the present invention.

As shown in FIG. 1, each actuator A1 to An has an actuator body 11 and a connector 12. The connector 12 further includes a connector body 13 and a cover 14.

Figure 3:
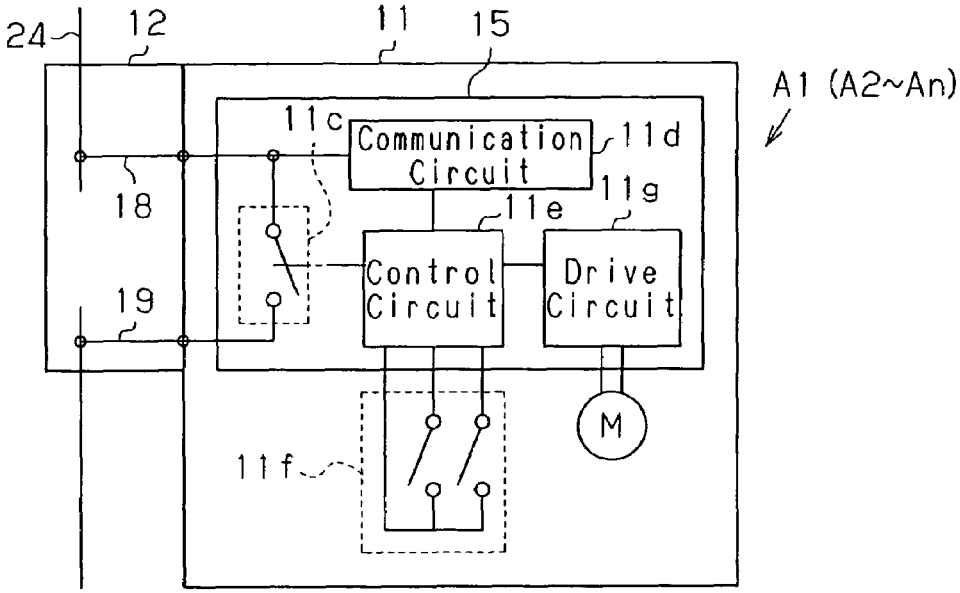
FIG. 3 is a schematic block diagram of the actuator of FIG. 1.

The actuator body 11 includes a socket (connector receiving portion) 11*a* for receiving the connector body 13. The socket 11*a* includes a plurality of (in the preferred embodiment, four) socket terminals 11*b*. As shown in FIG. 3, the actuator body 11 includes a switch 11*c*, a communication circuit 11*d*, a control circuit 11*e*, a sensor 11*f*, a drive circuit 11*g*, and a motor M, which functions as a driving portion. In the preferred embodiment, the switch 11*c*, the communication circuit 11*d*, the control circuit 11*e*, and the drive circuit 11*g* are integrated in a single customized control IC 15.

The connector body 13 is made of an insulative resin material and has a substantially box-like shape. The connector body 13 has a lower portion (lower side as viewed in FIG. 1, FIGS. 5 to 9) fitted in the socket 11*a*.

A pair of power supply terminals 16 and 17 (refer to FIG. 6), an input terminal 18 (refer to FIG. 7), an output terminal 19 (refer to FIG. 8), and a metal cutter 20 (FIG. 6), which functions as a cutting portion, are formed (through insert molding in the preferred embodiment) in the connector body 13. One of the power supply terminals 16 and 17 is a high potential power supply (+) terminal and the other one is a low potential power supply (GND) terminal.

Figure 5:
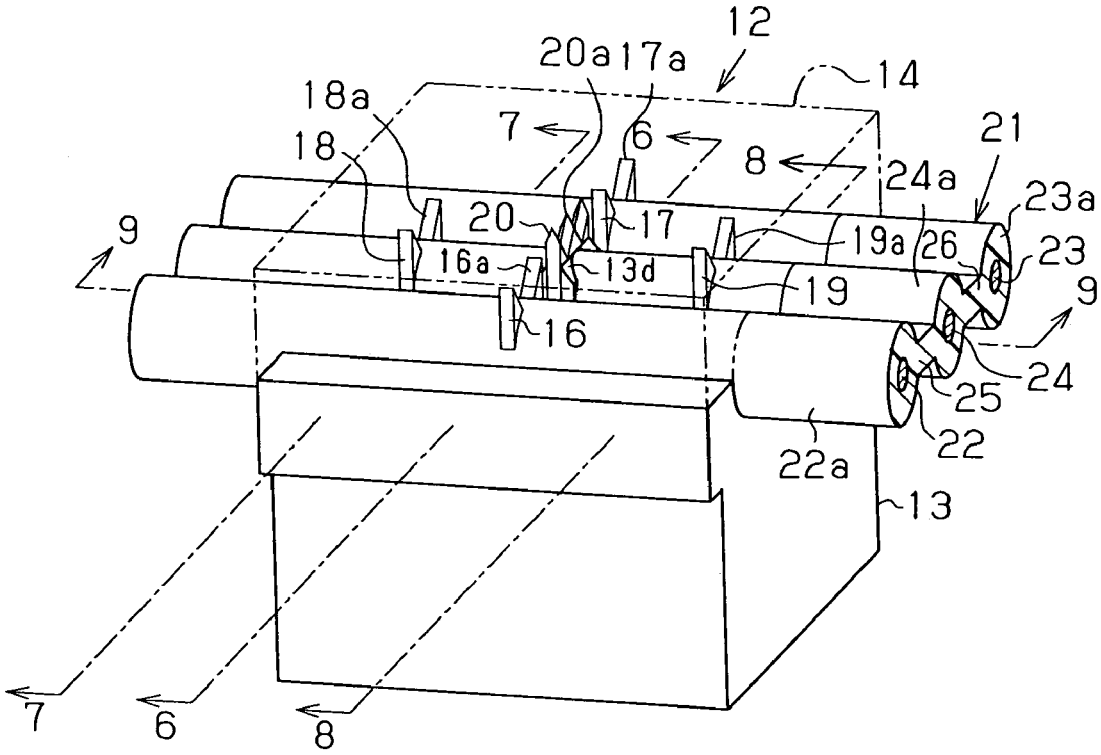
FIG. 5 is a perspective view showing a connector according to the preferred embodiment of the present invention.
Figure 6:
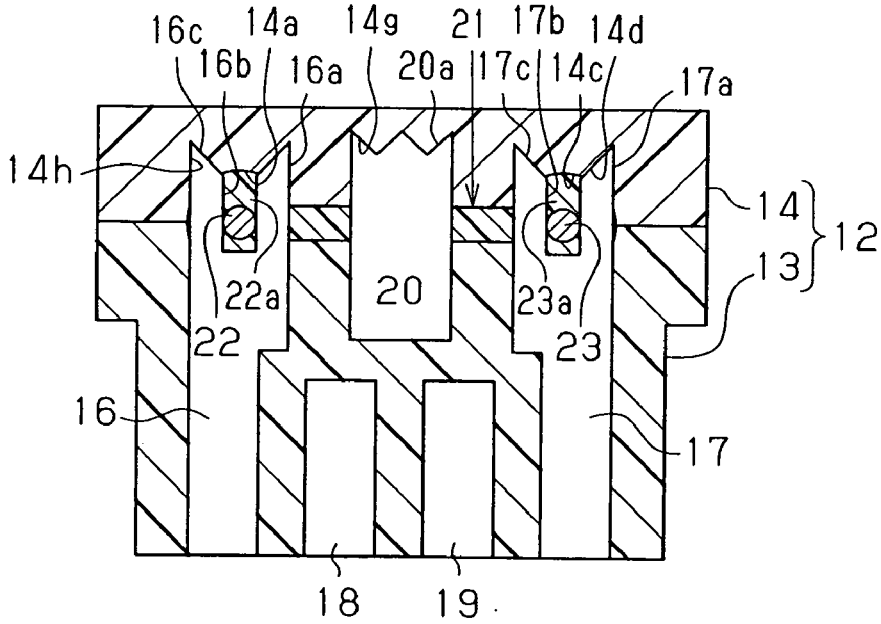
FIG. 6 is a cross sectional view taken along line 6—6 of the connector of FIG. 5.

More specifically, three parallel grooves 13*a*, 13*b*, and 13*c*, each having a substantially semi-cylindrical surface, are formed on an upper surface of the connector body 13 (as viewed in FIG. 1). As shown in FIG. 1, the power supply terminal 16 projects externally (upward) from the middle portion of the groove 13*a*. The power supply terminal 17 projects externally (upward) from the middle portion of the groove 13*c*. A direction parallel to the grooves 13*a*, 13*b*, and 13*c* is hereinafter referred to as a first direction. The two power supply terminals 16 and 17 linearly extend along a direction orthogonal to the first direction, as shown in FIG. 5 and FIG. 6. A direction parallel to the power supply terminals 16 and 17 is hereinafter referred to as a second direction. Further, a direction orthogonal to the first direction and the second direction is referred to as a third direction. A pair of contact portions 16*a* arranged along the third direction is formed at the distal portion of the power supply terminal 16. The pair of contact portions 16*a* define a slit 16*b* having an open top end. The open top end (upper end) of the slit 16*b* is interposed between two guides 16*c*. The space between the two guides 16*c* increases at upper positions. A pair of contact portions 17*a* arranged along the third direction is formed at the distal portion of the power supply terminal 17. The pair of contact portion 17*a* define a slit 17*b* having an open top end. The open top end (upper end) of the slit 17*b* is interposed between two guides 17*c*. The space between the two guides 17*c* increases at upper positions.

Figure 7:
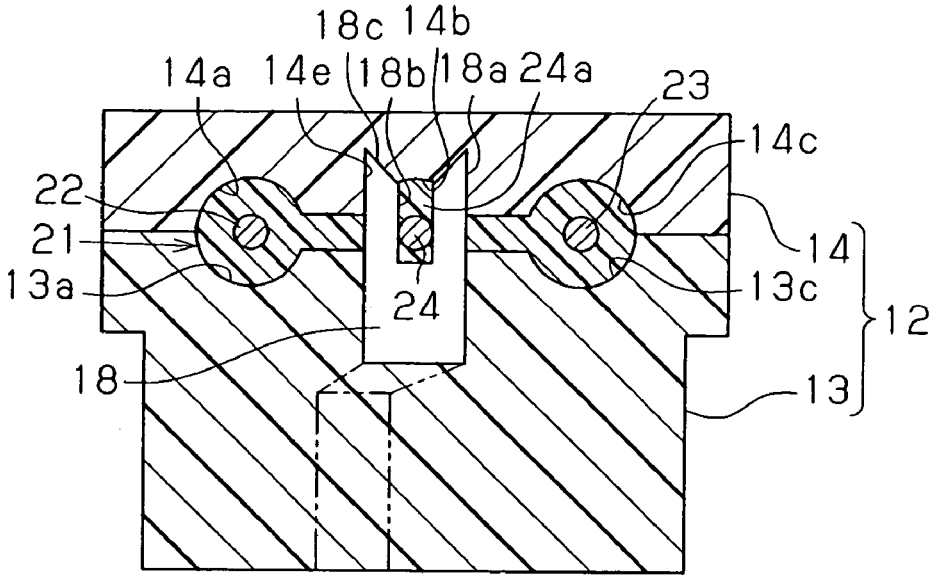
FIG. 7 is a cross sectional view taken along line 7—7 of the connector of FIG. 5.
Figure 9:
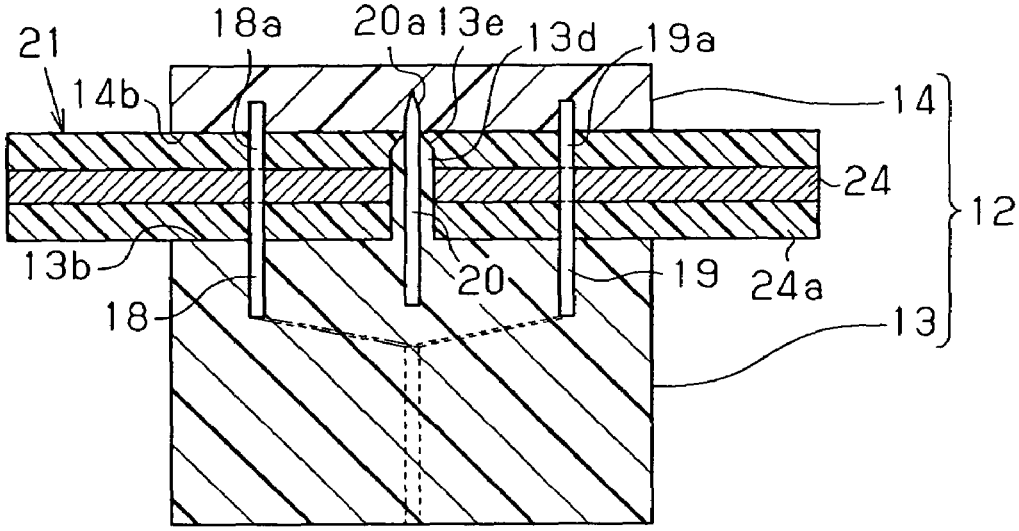
FIG. 9 is a cross sectional view taken along line 9—9 of the connector of FIG. 5.

Referring to FIGS. 1, 7, and 9, the distal end of the input terminal 18 projects externally (upward) from the groove 13*b* at a position separated from the center of the grooeve 13*b* in the first direction. As shown in FIGS. 7 and 9, a middle portion of the input terminal 18 is bent so that the lower end of the input terminal 18 is located in the vicinity of the lower end of the power supply terminal 16 (refer to FIG. 6).

Figure 8:
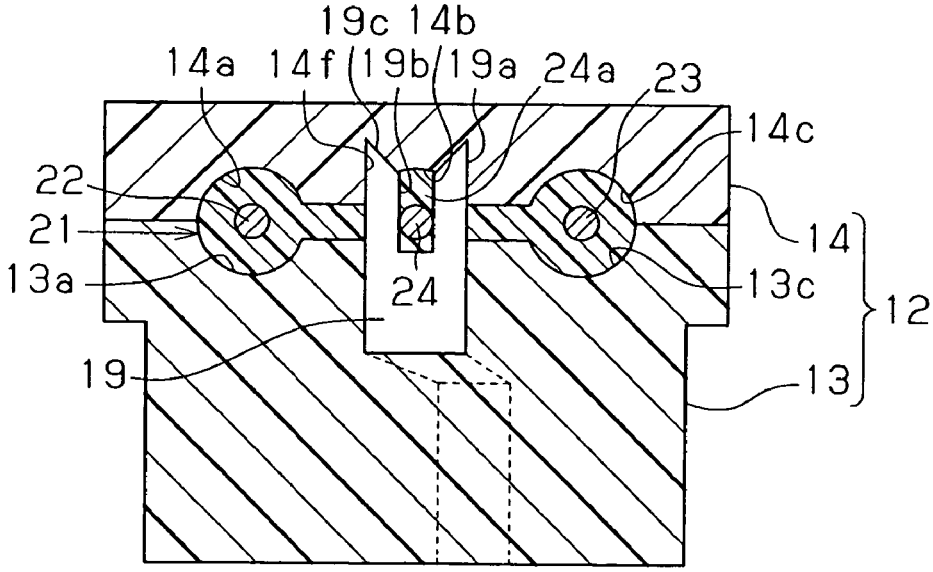
FIG. 8 is a cross sectional view taken along line 8—8 of the connector of FIG. 5.

Referring to FIGS. 1, 8, and 9, the distal end of the output terminal 19 projects externally (upward) from the groove 13*b* at a position separated from the center of the groove 13*b* in the first direction. As shown in FIGS. 8 and 9, a middle portion of the output terminal 19 is bent so that the lower end of the output terminal 19 is located in the vicinity of a lower end of the power supply terminal 17 (refer to FIG. 6).

A pair of contact portions 18*a* arranged along the third direction is formed at the distal portion of the input terminal 18 (refer to FIG. 7). The pair of contact portions 18*a* define a slit 18*b* having an open top end. The open top end (upper end) of the slit 18*b* is interposed between two guides 18*c*. The space between the two guides 18*c* increases at upper positions. A pair of contact portions 19*a* arranged along the third direction is formed at the distal portion of the output terminal 19 (refer to FIG. 8). The pair of contact portions 19*a* defines a slit 19*b* having an open top end. The open top end (upper end) of the slit 19*b* is interposed between two guides 19*c*. The space between the two guides 19*c* increases at upper positions.

As shown in FIG. 1, the metal cutter 20 is arranged so that the distal end of the metal cutter 20 projects externally (upward) from the central groove 13*b*. As shown in FIG. 6, the metal cutter 20 extends to the middle of the connector body 13 in the second direction from the central portion of the groove 13*b*, which is between the input terminal 18 and the output terminal 19 and between the power supply terminals 16 and 17 (refer to FIG. 6). A blade 20*a* for cutting a wire and the like is included at the tip of the metal cutter 20. The blade 20*a* of the preferred embodiment has two consecutive V-shaped (or W-shaped) upper ends arranged along the third direction. The exposed portion of the metal cutter 20 (excluding the blade 20*a*) is interposed between an insulator 13*d* extending from the connector body 13, as shown in FIG. 9. The insulator 13*d* of the preferred embodiment is integrally formed with the connector body 13. As shown in FIG. 9, a tapered portion 13*e* that narrows toward the distal end of the metal cutter 20 is formed at the upper end of the insulator 13*d*.

The basal portions of the power supply terminals 16 and 17, the input terminal 18, and the output terminal 19 are arranged so that the terminals 16 to 19 are connected to the corresponding socket terminals 11*b* when the connector body 13 is fitted into the socket 11*a*.

As shown by the broken lines in FIG. 5, the cover 14 may be fixed to the upper end of the connector body 13 by, for example, a hook (not shown). Referring again to FIG. 1, the lower surface the cover 14, or the surface facing the connector body 13, is formed with three parallel grooves 14*a*, 14*b* and 14*c*, each having a substantially semi-cylindrical surface similar to that of the grooves 13*a*, 13*b* and 13*c*. Further, accommodating portions 14*d* to 14*h* for accommodating the distal ends of the power supply terminals 16 and 17, the input terminal 18, the output terminal 19, and the metal cutter 20 are formed in the lower surface of the cover 14, as shown in FIGS. 6 to 8. Therefore, the cover 14 holds the ribbon-shaped harness 21 in cooperation with the connector body 13. As shown in FIG. 5, the ribbon-shaped harness 21 includes a pair of parallel power supply lines 22 and 23, a communication line (signal line) 24 arranged between the power supply lines 22 and 23, insulation films 22*a* to 24*a* respectively covering the lines 22 to 24, and connecting portions 25 and 26 integrally formed with the insulation films 22*a* to 24*a* to connect the adjacent insulation films 22*a* to 24*a*.

The actuators A1 to An are connected to the single ribbon-shaped harness 21, which is further connected to the master controller 1, in the order of A1, A2, . . . , and An. Each actuator A1 to An is connected in series (daisy chain connected) with respect to the communication line 24 and connected in parallel with respect to the pair of power supply lines 22 and 23.

More specifically, each actuator A1 to An is connected to the communication line 24 and the pair of power supply lines 22 and 23 by attaching the connector body 13 and the cover 14 to each other so as to hold the ribbon-shaped harness 21 in between (connecting operation).

When attaching the connector body 13 and the cover 14 to each other, the communication line 24 and the insulation film 24*a* of the ribbon-shaped harness 21 held between the connector body 13 and the cover 14 are cut (sheared) with the metal cutter 20 (blade 20*a*), as shown in FIG. 9. The communication line 24 and the insulation film 24*a* are cut smoothly (prevented from getting caught) due to the tapered portion 13*e* formed on the insulator 13*d*. Simultaneously, the input terminal 18 and the output terminal 19 contacting the insulation film 24*a* penetrate through the insulation film 24*a* with the contact portions 18*a* and 19*a* (slits 18*b* and 19*b*) of the input terminal 18 and the output terminal 19. Two cut pieces formed by cutting the communication line 24 respectively contact the contact portions 18*a* and 19*a* and connect to the input terminal 18 and the output terminal 19. Further, as shown in FIG. 6, the contact portions 16*a* and 17*a* (slits 16*b* and 17*b*) of the power supply terminals 16 and 17 penetrate through the insulation films 22*a* and 23*a* of the power supply lines 22 and 23. The power supply lines 22 and 23 contact the contact portions 16*a* and the 17*a* and connect to the power supply terminals 16 and 17. Therefore, each actuator A1 to An is daisy chain connected with respect to the communication line 24 of the ribbon-shaped harness 21 (refer to FIG. 2) and connected in parallel with respect to the pair of power supply lines 22 and 23.

As shown in FIG. 3, in each actuator A1 to An, the input terminal 18 and the output terminal 19 are connected to each other by the switch 11*c*. The input terminal 18 is connected to the control circuit 11*e* through the communication circuit 11*d*. The control circuit 11*e* is connected to the switch 11*c*, the sensor 11*f*, and the drive circuit 11*g*. The drive circuit 11*g* is connected to the motor M. In each actuator A1 to An, the power supply terminals 16 and 17 are connected to the control IC 15. Power is supplied to each component by way of the power supply terminals 16 and 17.

Figure 4:
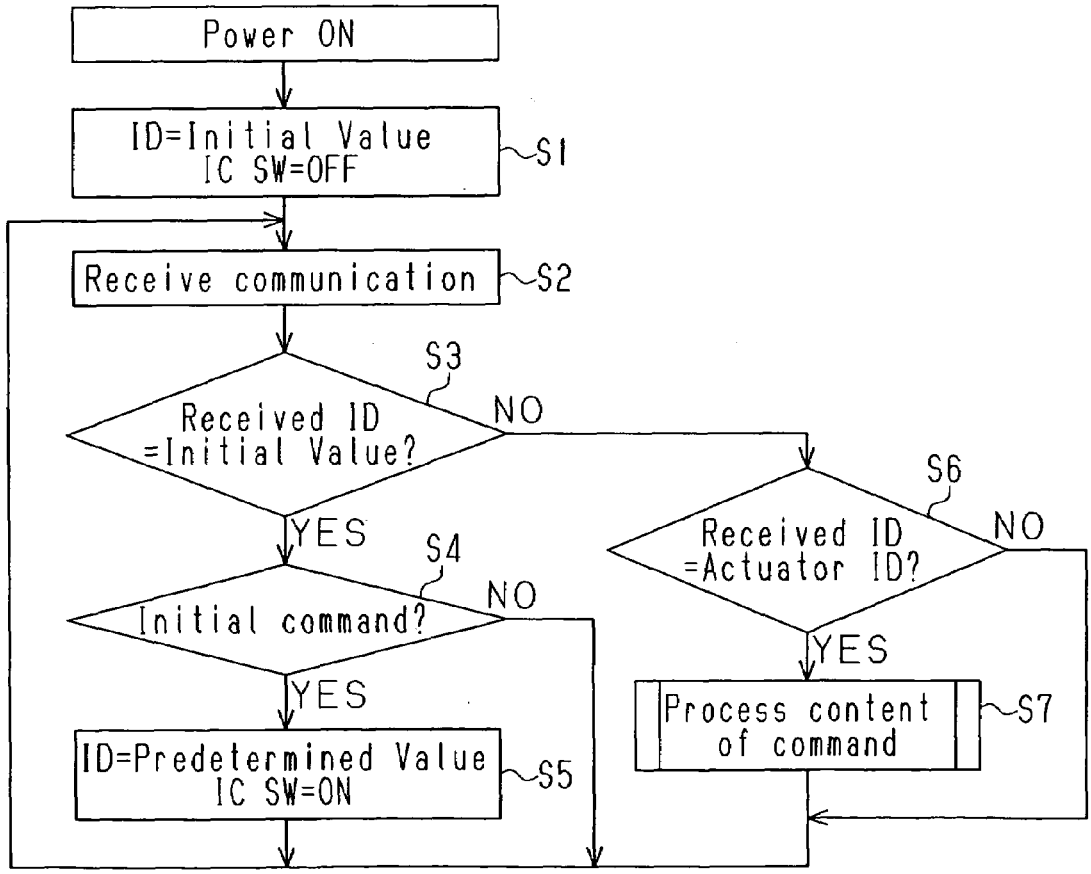
FIG. 4 is a flowchart of a process performed by a control circuit in the actuator of FIG. 1.

When a vehicle ignition switch (not shown) is turned on, the actuator system 100 is provided with power (energized). As a result, the control circuit 11*e* of the preferred embodiment starts the processes of steps S1 to S7, as shown in FIG. 4.

When the actuator system 100 is energized (power ON), in step S1, the control circuit 11*e* is reset (i.e., the ID number is initialized and the IC SW is inactivated). More specifically, when reset, the control circuit 11*e* sets its address value to an initial value (in the preferred embodiment "0"). Further, the control circuit 11*e* opens (inactivates) the switch 11*c* and disconnects the input terminal 18 from the output terminal 19.

Subsequently, the control circuit 11*e* waits until receiving a control signal via the input terminal 18 and the communication circuit 11*d*. When receiving the control signal in step S2, the control circuit 11*e* proceeds to step S3.

In step S3, the control circuit 11*e* determines whether the value of the address information included in the received control signal is an initial value (in the preferred embodiment, "0"). In step S3, when the control circuit 11*e* determines that the value of the address information in the control signal is the initial value (in the preferred embodiment, "0"), the control circuit 11*e* proceeds to step S4.

In step S4, the control circuit 11*e* determines whether the command information included in the control signal is an initial command. An initial command is a command for setting the address value of the control circuit 11*e* to a predetermined value (e.g., "1"). When determining that the command information is the initial command in step S4, the control circuit 11*e* proceeds to step S5. Further, when determining that the command information is not the initial command in step S4, the control circuit 11*e* proceeds to step S2.

In step S5, the control circuit 11*e* sets the address (i.e., the ID number is set to a predetermined number and the IC SW is activated). More specifically, the control circuit 11*e* replaces its initial address value (in the preferred embodiment, "0") with a predetermined value (e.g., "1"), which is included in the control signal. Further, the control circuit 11*e* closes (activates) the switch 11*c* and connects the input terminal 18 and the output terminal 19 to each other. When step S5 is completed, the control circuit 11*e* proceeds to step S2.

In step S3, when the control circuit 11*e* determines that the value of the address information in the control signal is not the initial value (in the preferred embodiment, "0"), the control circuit 11*e* proceeds to step S6.

In step S6, the control circuit 11*e* determines whether the value of the address information included in the control signal is its own address value (e.g., "1"). When the control circuit 11*e* determines that the value of the address information included in the control signal is its own address value (e.g., "1") in step S6, the control circuit 11*e* proceeds to step S7. Conversely, when the control circuit 11*e* determines that the value of the address information included in the control signal is not its own address value (e.g., "1") in step S6, the control circuit 11*e* proceeds to step S2.

In step S7, the control circuit 11*e* generates a drive signal for controlling the motor M in accordance with the command information included in the control signal and a sensor signal provided from the sensor 11*f*. The control circuit 11*e* provides the drive signal to the drive circuit 11*g*. The sensor 11*f* of the preferred embodiment is a Hall IC for detecting the rotational angle (position) of a rotor in the motor M. When step S7 is completed, the control circuit 11*e* proceeds to step S2.

The operation of the entire actuator system 100 (master controller 1 and actuators A1 to An) will now be discussed.

When the vehicle ignition switch is turned ON (i.e., when the actuator system 100 is energized), the control circuit 11*e* of each of the actuators A1 to An executes steps S1 and S2. This sets the address value to the initial value (in the preferred embodiment, "0") in each of the actuators A1 to An. Further, in each of the actuators A1 to An, the switch 11*c* is opened (inactivated), and the input terminal 18 and the output terminal 19 are disconnected from each other.

After a time elapses that ensures the completion of step S1 in the actuators A1 to An from when the master controller 1 is energized, the master controller 1 sequentially transmits the first control signal (address setting signal), which sets an address. In the address setting signal, the value of the address information is the initial value (i.e., "0"), and the command information is the initial command. The master controller 1 sequentially changes the predetermined value in the initial command of the sequentially transmitted control signal (address setting information).

The actuators A1 to An sequentially execute steps S3 to S5 (in response to the first control signal in the first actuator A1, in response to the second control signal in the actuator A2 of the next stage). In other words, the transmission of the address setting signal sets the address values of the actuators A1 to An respectively to "1", "2", . . . , and "n" and connects all of the input terminals 18 and the output terminals 19 to one another. After step S1, the control circuit 11*e* in each of the actuators A1 to An waits until receiving the control signal in step S2.

When, for example, a switch (not shown) for controlling an air door is operated, the master controller 1 transmits a control signal in accordance with the switch operation.

For example, in accordance with a switch operation, the master controller 1 transmits a control signal indicating that the address information value is "2" and the command information is that "the rotor of the motor M is to be rotated to a predetermined position". Subsequently, all of the actuators A1 to An receive the control signal. In the actuators A1, and A3 to An, if the value "2" of the address information in the received control signal does not match the actuator address value, steps S3 and S6 are executed. The actuators A1, and A3 to An therefore do not take any meaningful actions. In the actuator A2, steps S3, S6, and S7 are executed. That is, the drive circuit 11*g* is provided with a drive signal corresponding to the command information. Thus, in the actuator A2, the drive circuit 11*g* supplies the motor M with power to rotate the rotor of the motor M to the predetermined position and drive (open or close) the air door.

In the above mentioned actuator system 100, a plurality of actuators A1 to An are independently controlled without the need of a circuit to set different ID numbers for each actuator A1 to An.

The preferred embodiment has the following advantages.

(1) When attaching the connector body 13 and the cover 14 to each other, the communication line 24 of the ribbon-shaped harness 21 held between the connector body 13 and the cover 14 is cut by the metal cutter 20 (blade 20*a*). Further, when attaching the connector body 13 and the cover 14 to each other, the insulation film 24*a* contacting the input terminal 18 and the output terminal 19 is penetrated by the contact portions 18*a* and 19*a* of the input terminal 18 and the output terminal 19, as shown in FIG. 7 and FIG. 8. The two cut pieces formed when cutting the communication line 24 contact the contact portions 18*a* and 19*a* and connect to the input terminal 18 and the output terminal 19. Therefore, the actuators A1 to An are easily (through a simple task) daisy chain connected to the communication line 24 of the single simple-shaped ribbon-shaped harness 21 (in which the power supply lines 22 and 23, the communication line 24, and the insulation films 22*a* to 24*a* are formed in the same manner). As a result, the cost for configuring the actuator system 100 is reduced.

(2) The cutting portion for cutting the communication line 24 is the metal cutter 20, which is integrally formed with the connector body 13 and the terminals 16 to 19 through insert molding. Therefore, through the same (single) insert molding, terminals 16 to 19 and the metal cutter 20 are easily included in the connector body 13. The portion of the metal cutter 20 exposed from the connector body 13 (excluding the blade 20*a*) is interposed between the insulator 13*d*, as shown in FIG. 9. Therefore, the adjacent pieces of the communication lines 24 cut by the metal cutter are prevented from being electrically connected to each other.

(3) The insulator 13*d* is integrally formed with the connector body 13. Therefore, the insulator 13*d* is easily included in the connector body 13 without increasing the number of components or the number of connecting operations.

(4) When attaching the connector body 13 and the cover 14 to each other, the insulation films 22*a* and 23*a* of the pair of power supply lines 22 and 23 are penetrated by the contact portions 16*a* and the 17*a* of the power supply terminals 16 and 17. The pair of power supply lines 22 and 23 then contact the contact portions 16*a* and 17*a* and connect to the power supply terminals 16 and 17, as shown in FIG. 6. The actuators A1 to An are easily connected in parallel by the power supply lines 22 and 23 of the single simple-shape ribbon-shaped harness 21 (in which the power supply lines 22 and 23, communication line 24, and the insulation films 22*a* to 24*a* are formed in the same manner).

(5) When reset, the input terminal 18 and the output terminal 19 in each of the actuators A1 to An are disconnected from each other. Subsequently, the address value of the actuators A1 to An are sequentially set and the input and output terminals 18 and 19 are sequentially connected to each other. Thus, until the next reset, the control signal for controlling the motor M is provided to all of the actuators A1 to An through each switch 11*c* regardless of the address information of the control signal. In the actuator in which the value of the address information of the control signal matches the set actuator address value, the drive signal is provided to the drive circuit 11*g*, in accordance with the command information of the control signal, to drive the motor M. In the actuator system 100 using the above actuators A1 to An, all of the actuators A1 to An receive the control signal controlling the motor M at about the same time regardless of the address information of the control signal. That is, the control signal for controlling the motor M is transmitted to all of the actuators A1 to An at about the same time without performing various processes (a storage process for storing the control signal, address determination process for comparing the value of the address information of the control signal and the actuator address value, transmission process for transmitting the control signal to the actuator in the next stage) on the control signal in each actuator A1 to An even when employing the daisy chain connection. Thus, the responsiveness of each actuator A1 to An, especially the final actuator An, is satisfactory.

It should be apparent to those skilled in the art that the present invention may be embodied in many other specific forms without departing from the spirit or scope of the invention. Particularly, it should be understood that the present invention may be embodied in the following forms.

In the preferred embodiment, the insulator 13*d* is integrally formed with the connector body 13. However, the present invention is not limited to such a configuration, and other configurations may be employed. For example, other structures may be used to prevent the adjacent pieces of the communication lines 24 cut by the metal cutter 20 from being electrically connected to each other.

Figure 10:
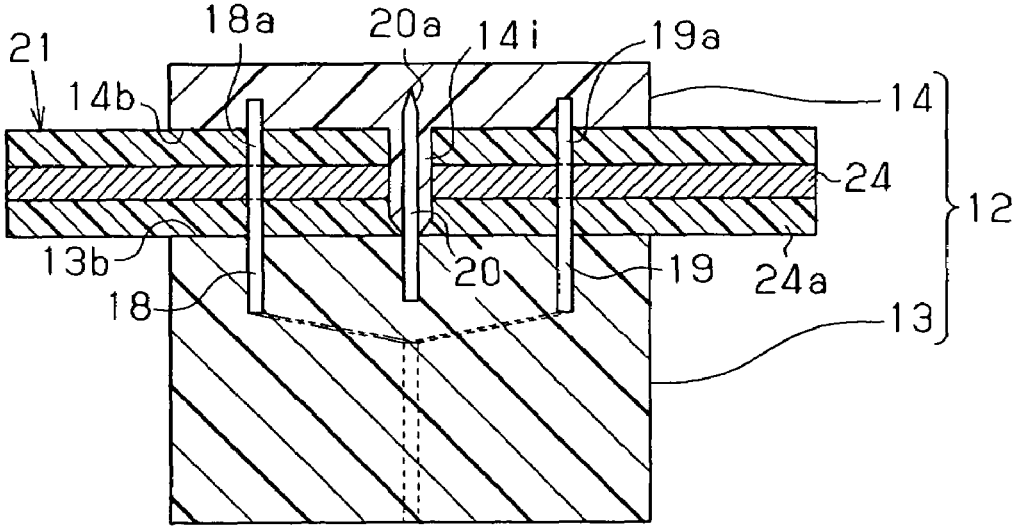
FIG. 10 is a cross sectional view of a connector according to a another embodiment of the present invention.

Referring to FIG. 10, for example, an insulator 14*i* may be integrally formed with the cover 14 so as to cover the portion of the metal cutter 20 exposed from the connector body 13. Such a configuration also facilitates the formation of the insulator 14*i* in the cover 14 while preventing the cut pieces of the communication lines 24 from being electrically connected to each other without increasing the number of components and the number of connecting operations.

An insulator may be formed by, for example, coating the surface of the metal cutter 20 with an insulative material. In this configuration, the surface of the metal cutter 20 is coated, for example, with the insulator (insulative material). This facilitates the formation of the metal cutter 20 including the insulator in the connector body 13 or the cover 14.

The insulator 13*d* may be arranged on only one side (for example, only on the left side in FIG. 9) of the metal cutter 20. In this configuration, one cut end of the communication line 24 cut with the metal cutter 20 is electrically connected to the metal cutter 20. However, the other cut end cut pieces of the communication lines 24 are prevented from being electrically connected to the metal cutter 20. In other words, the cut pieces of the communication line 24 are not electrically connected to each other.

In the preferred embodiment, the metal cutter 20 (cutting portion) is included in the connector body 13. However, the present invention is not limited to such a configuration and the cutting portion may be included in either the connector body or the cover. For example, the cutting portion may be included in the cover 14 (through insert molding).

In the preferred embodiment, the cutting portion is the metal cutter 20. However, the cutting portion may also be made of an insulative material (for example, ceramics and the like). In such a configuration, the insulator 13*d* is not necessary and the cut pieces of the communication line 24 are prevented from being electrically connected to each other.

In the preferred embodiment, the ribbon-shaped harness 21 includes the power supply lines 22 and 23 and the communication line 24. However, the quantity and the types of the conductive wires are not limited in such a manner. The ribbon-shaped harness 21 may be changed as long as it includes at least one signal line for daisy chain connection.

In the preferred embodiment, the actuators A1 to An each have a switch 11*c*. Further, after setting the actuator address value, the control signal for controlling the motor M is transmitted to all the actuators A1 to An almost at about the same time regardless of the address information of the control signal. However, the configuration of the actuator is not limited to such a configuration. The storage process, the address determination process, and the transmission process may be performed on the control signal for controlling the motor M. Such a configuration also has advantages (1) to (4).

In the preferred embodiment, the connector body 13 and the cover 14 are separate components. However, the present invention is not limited to such a configuration, and the connector body and the cover may also be integrally formed with each other by way of a thin hinge so that the connector body and the cover hold the ribbon-shaped harness 21 in between. The connector body 13 and a housing of the actuator body 11 may also be integrally molded.

In the preferred embodiment, the actuator system 100 is used in a vehicle air conditioner. However, the present invention is not limited to such an application and the actuator system 100 including the actuators A1 to An may be used for other applications.

In the preferred embodiment, the actuators A1 to An each include a motor M, which functions as a driving portion. However, other devices may be used as the driving portion (e.g., motor that produces linear action or an electromagnetic solenoid).

In the present embodiment, the connector 12 is used in the actuators A1 to An. However, the connector including a cutting portion may also be used for other applications.

The present examples and embodiments are to be considered as illustrative and not restrictive, and the invention is not to be limited to the details given herein, but may be modified within the scope and equivalence of the appended claims.

What is claimed is:

1. An actuator for connection to a harness including a signal line covered by a coating, the actuator comprising:

a connector body including an input terminal and an output terminal;

a cover attached to the connector body to hold the harness with the connector body;

at least one of the connector body and the cover including a cutting portion arranged between the input terminal and the output terminal to cut the signal line of the harness into two cut pieces when attaching the connector body and the cover to each other;

the input terminal and the output terminal each including two contact portions that penetrate through the coating of the signal line of the harness to contact one of the two cut pieces of the signal line when attaching the connector body and the cover to each other;

the cutting portion including an insulator for preventing the two cut pieces of the signal line from being electrically connected with each other; and the insulator including a distal end and a tapered portion that narrows toward the distal end.

2. An actuator for connection to a harness including a signal line covered by a coating, the actuator comprising:

a connector body including an input terminal and an output terminal;

a cover attached to the connector body to hold the harness with the connector body;

at least one of the connector body and the cover including a cutting portion arranged between the input terminal and the output terminal to cut the signal line of the harness into two cut pieces when attaching the connector body and the cover to each other;

the input terminal and the output terminal each including two contact portions that penetrate through the coating of the signal line of the harness to contact one of the two cut pieces of the signal line when attaching the connector body and the cover to each other;

the cutting portion including an insulator for preventing the two cut pieces of the signal line from being electrically connected with each other; and the cutting portion is a metal cutter insert molded in the connector body along with the input terminal and the output terminal.

3. The actuator as claimed in claim 2, wherein the cutter has a surface coated by a coating layer formed from an insulative material.

4. An actuator for connection to a harness including a signal line covered by a coating, the actuator comprising:

a connector body including an input terminal and an output terminal;

a cover attached to the connector body to hold the harness with the connector body;

at least one of the connector body and the cover including a cutting portion arranged between the input terminal and the output terminal to cut the signal line of the harness into two cut pieces when attaching the connector body and the cover to each other;

the input terminal and the output terminal each including two contact portions that penetrate through the coating of the signal line of the harness to contact one of the two cut pieces of the signal line when attaching the connector body and the cover to each other;

the cutting portion including an insulator for preventing the two cut pieces of the signal line from being electrically connected with each other;

the connector body including two power supply terminals;

the harness including two power supply lines, each extending parallel to the signal line and being covered by a coating; and the two power supply terminals each having a contact portion that penetrates through the coating of an associated one of the power supply lines to contact the associated power supply line when attaching the connector body and the cover to each other.

5. The actuator as claimed in claim 2, wherein the cutting portion includes a blade having a W-shaped upper end.

6. An actuator for connection to a harness including a signal line covered by a coating, the actuator comprising:

a connector body including an input terminal and an output terminal;

a cover attached to the connector body to hold the harness with the connector body;

a switch connected between the input terminal and the output terminal; and a control circuit connected to the switch, in which the control circuit is operable for setting an address value for itself, at least one of the connector body and the cover including a cutting portion arranged between the input terminal and the output terminal to cut the signal line of the harness into two cut pieces when attaching the connector body and the cover to each other;

the input terminal and the output terminal each including two contact portions that penetrate through the coating of the signal line of the harness to contact one of the two cut pieces of the signal line when attaching the connector body and the cover to each other; and the control circuit sets an initial value, opens the switch to disconnect the input terminal and the output terminal from each other, changes the initial value to a predetermined value that is used as the address value, and closes the switch to connect the input terminal and the output terminal to each other.

7. An actuator for connection to a harness including a signal line covered by a coating, the actuator comprising:

a connector used to connect the actuator to the harness, the connector including:

a connector body including a first groove, which is shaped in correspondence with the harness, and an input terminal and an output terminal, which are arranged in the first groove;

a cover for folding the harness with the connector body, the cover including a second groove corresponding to the first groove;

a cutting portion arranged between the input terminal and the output terminal in at least one of the first groove of the connector body and the second groove of the cover, the cutting portion cutting the signal line of the harness into two cut pieces when attaching the connector body and the cover to each other, the input terminal and the output terminal each including:

two contact portions that penetrate through the coating of the signal line of the harness to contact one of the two cut pieces of the signal line when attaching the connector body and the cover to each other, wherein the cutting portion includes an insulator having a distal end and a tapered portion that narrows toward the distal end, and a blade having a W-shaped upper end.

8. An actuator for connection to a harness including a signal line covered by a coating, the actuator comprising:

a connector used to connect the actuator to the harness, the connector including:

a connector body including a first groove, which is shaped in correspondence with the harness, and an input terminal and an output terminal, which are arranged in the first groove;

a cover for folding the harness with the connector body, the cover including a second groove corresponding to the first groove;

a cutting portion arranged between the input terminal and the output terminal in at least one of the first groove of the connector body and the second groove of the cover, the cutting portion cutting the signal line of the harness into two cut pieces when attaching the connector body and the cover to each other, the input terminal and the output terminal each including:

two contact portions that penetrate through the coating of the signal line of the harness to contact one of the two cut pieces of the signal line when attaching the connector body and the cover to each other, wherein the connector body includes a third groove and a fourth groove shaped in correspondence with the harness, a first power supply terminal arranged in the third groove, and a second power supply terminal arranged in the fourth groove;

the cover includes a fifth groove corresponding to the third groove and a sixth groove corresponding to the fourth groove;

the harness includes a first power supply line, associated with the third and the fifth grooves and covered by a coating, and a second power supply line, associated with the fourth and sixth grooves and covered by a coating;

the first power supply terminal includes a first contact portion that penetrates through the coating of the first power supply line to contact the first power supply line when attaching the connector body and the cover to each other; and the second power supply terminal includes a second contact portion that penetrates through the coating of the second power supply line to contact the second power supply line when attaching the connector body and the cover to each other.

9. A connector for connecting a plurality of devices by way of a harness including a signal line covered by a coating, the connector comprising:

a connector body including an input terminal and an output terminal;

a cover for folding the harness with the connector body, at least one of the connector body and the cover including a cutting portion arranged between the input terminal and the output terminal to cut the signal line of the harness into two cut pieces when attaching the connector body and the cover to each other, and the input terminal and the output terminal each including two contact portions that penetrate through the coating of the signal line of the harness to contact one of the two cut pieces of the signal line when attaching the connector body and the cover to each other, wherein the cutting portion includes an insulator for preventing the two cut pieces of the signal line from wherein the cutting portion is a metal cutter insert molded in the connector body along with the input terminal and the output terminal.

10. The actuator as claimed in claim 1, wherein the insulator is integrally formed with at least one of the connector body and the cover.

* * * * *